United States Patent [19]

Fanti

[11] Patent Number: 4,567,615

[45] Date of Patent: Feb. 4, 1986

[54] SPRING-SLAT ARRANGEMENT FOR A BEDSTEAD

[75] Inventor: Hansruedi Fanti, Flüh, Switzerland

[73] Assignee: Matra AG, Flüh, Switzerland

[21] Appl. No.: 568,077

[22] Filed: Jan. 4, 1984

[30] Foreign Application Priority Data

Jan. 13, 1983 [CH] Switzerland ..... 178/83

[51] Int. Cl.[4] ..... A47C 23/06

[52] U.S. Cl. ..... 5/191; 5/237; 5/238; 267/48; 267/42; 267/54 R

[58] Field of Search ..... 5/236 R, 236 B, 237, 5/238, 191; 267/48, 42, 54 R

[56] References Cited

U.S. PATENT DOCUMENTS

| | | | |
|---|---|---|---|
| 187,961 | 3/1977 | Burch | 5/237 |
| 198,301 | 12/1977 | Jensen | 5/237 |
| 2,349,839 | 5/1944 | Apicella | 267/1 |
| 4,136,411 | 1/1979 | Fanti | 5/191 |
| 4,222,134 | 9/1980 | Degen | 5/191 |
| 4,369,535 | 1/1983 | Ekkerink | 5/237 |

FOREIGN PATENT DOCUMENTS

| | | | |
|---|---|---|---|
| 492431 | 7/1919 | France | 5/237 |
| 506275 | 6/1971 | Switzerland | 5/237 |
| 600836 | 6/1978 | Switzerland . | |

*Primary Examiner*—Alexander Grosz

*Attorney, Agent, or Firm*—Philip M. Shaw, Jr.

[57] ABSTRACT

The arrangement comprises mounting supports for the spring slats, insertable in the longitudinal beams of the bedstead, with two upper spring-slats serving as a support for the mattress and undulating spring-slats situated below them. A tiltable holding part having four receptacles for the spring-slats is fitted on a plug of the mounting support. Below the plug there is a resilient bearing pad enabling the holding part to deflect vertically. The upper spring-slats are bent convexly upward and have a broadened cross-section in the middle. By means of the undulating lower spring-slats, a progressive spring action is achieved. There is no sagging of the mattress in the region of heavier parts of the body, optimum spring action being ensured nonetheless. It is possible to divide the bedstead into zones of differing degrees of firmness by selectively providing mounting supports with only upper spring-slats or with additional lower spring-slats.

12 Claims, 9 Drawing Figures

SPRING-SLAT ARRANGEMENT FOR A BEDSTEAD

This invention relates to bed constructions, and more particularly to a spring-slat arrangement of the type having two mounting supports for the spring-slats, insertable in the longitudinal beams of a bedstead, which make possible a vertical deflection and a tilting of the spring-slats.

Spring-slats or resilient transverse laths for bedsteads, as well as mounting supports for a springy and tiltable attachment thereof in the longitudinal beams of a bedstead, have already been proposed, e.g., in applicant's Swiss Pat. No. 600,836. In the prior art arrangements, however, the degree of deflection or elastic temper of the spring-slats is the same all over the bedstead. The disadvantage of this is that in the region of lighter parts of the body there is only slight deflection, whereas in the region of heavier parts of the body the mattress may sag.

Sagging of the resilient slats has been prevented by various technical measures. However, all these measures are based on the principle of making a certain zone of the reclining surface less resilient by disposing additional spring-slats there, which begin to react immediately from the first moment of loading by the person lying thereon. The reclining surface is thereby locally hardened.

It is therefore an object of this invention to provide an improved spring-slat arrangement which makes possible a progressive deflection of the resilient slat upon loading of the mattress.

A further object of the invention is to provide a spring-slat arrangement enabling optimum elastic resiliency without sagging of the mattress in the region of heavier parts of the body or in the case of heavily-built persons.

To this end, in the spring-slat arrangement according to the present invention, of the type initially mentioned, the improvement comprises at least one upper spring-slat serving as a support for the mattress and at least one lower spring-slat preventing the mattress from sagging, the upper spring-slat deflecting alone in a first flexure zone and together with the lower spring-slat in a second flexure zone.

When the spring-slat arrangement is used in a bedstead, it is possible to divide the latter into zones of differing degrees of firmness by selectively inserting the spring-slat arrangement according to the present invention or a spring-slat arrangement having only upper slats.

Figure 1:
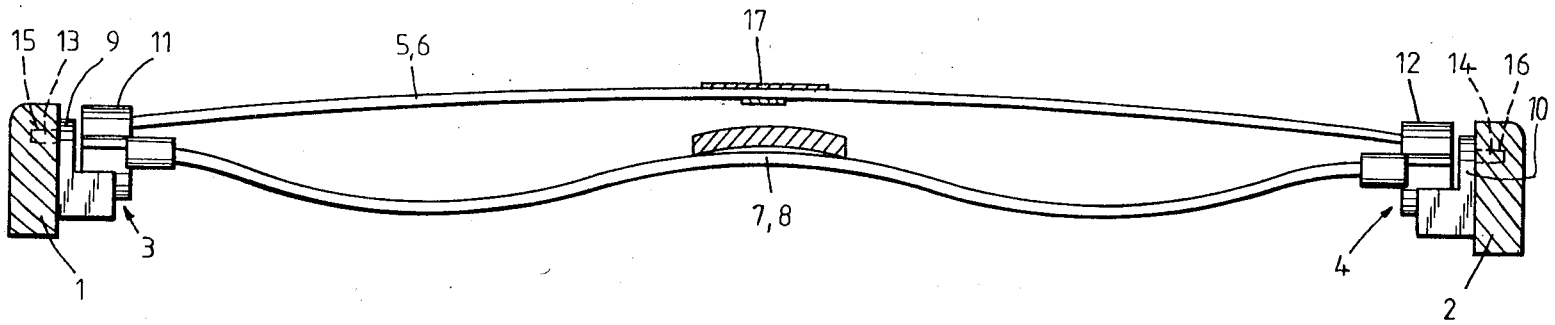
Figure 7:
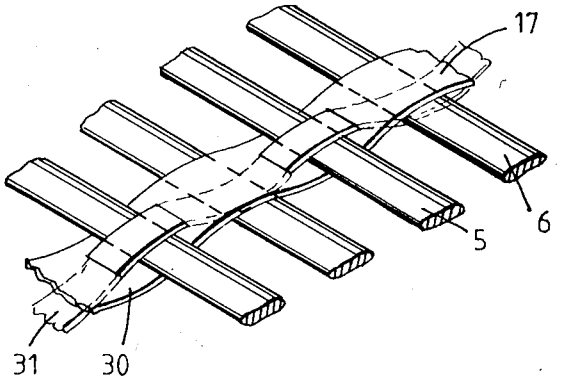
Figure 2:
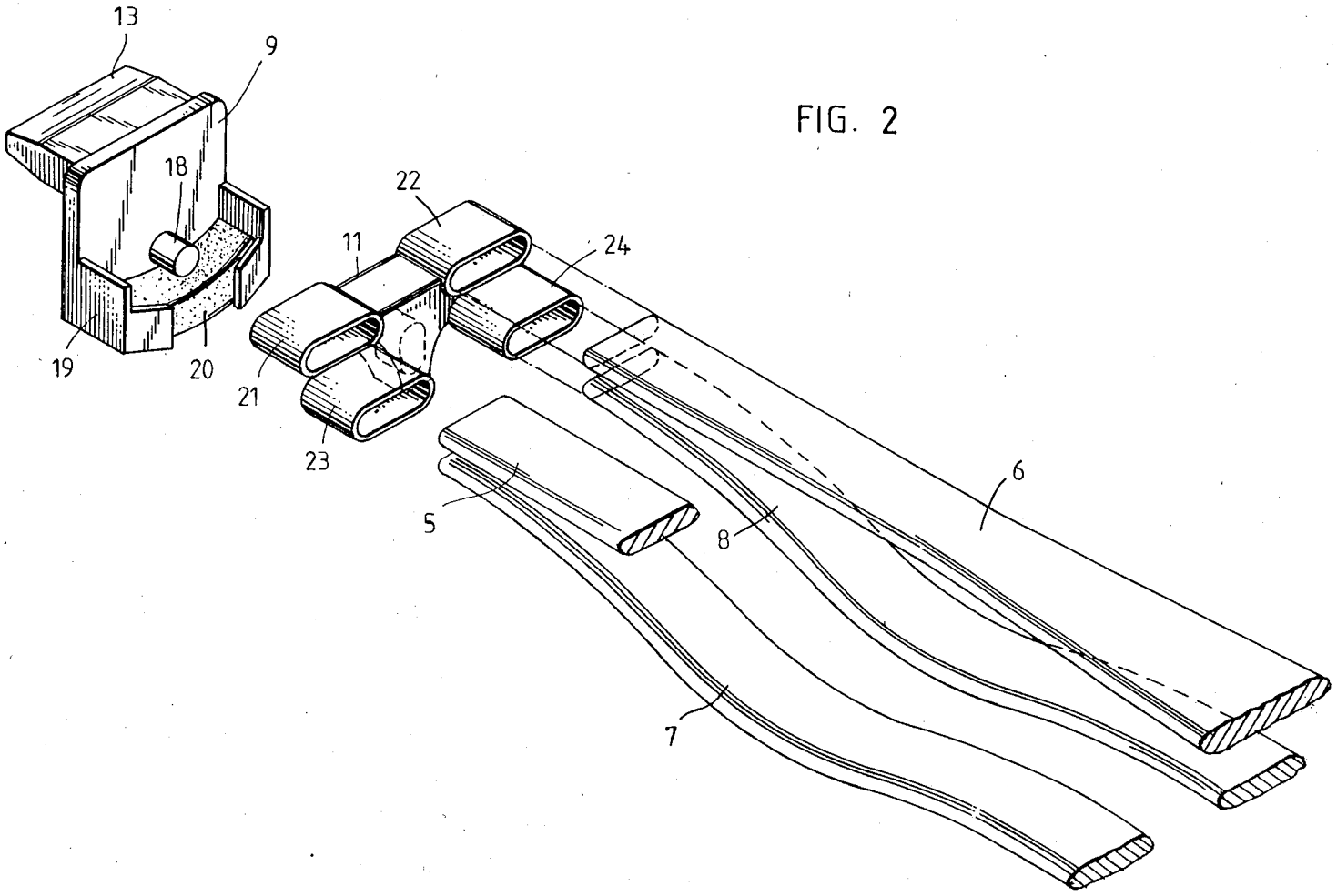
Figure 3:
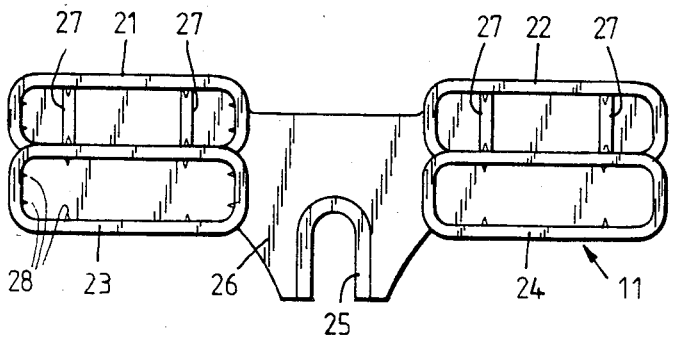
Figure 4:
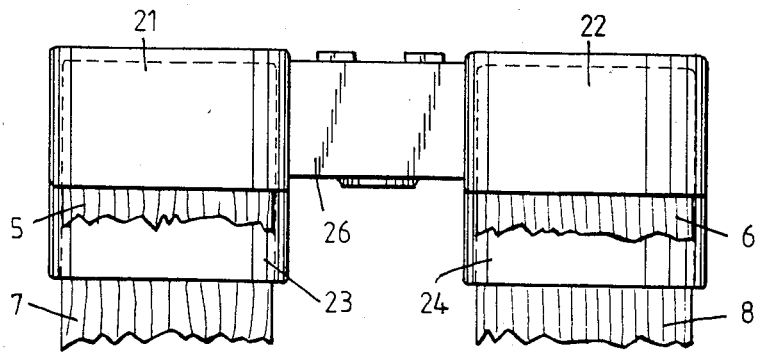
Figure 6:
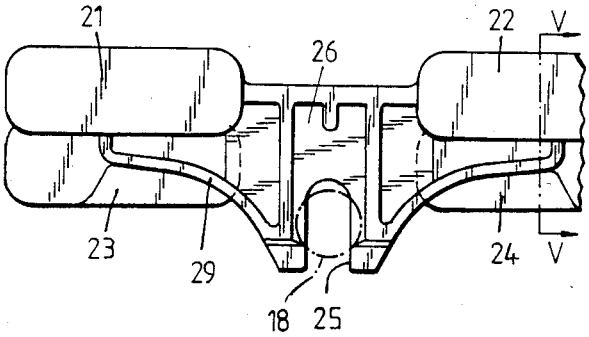
Figure 5:
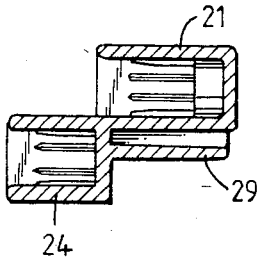
Figure 8:
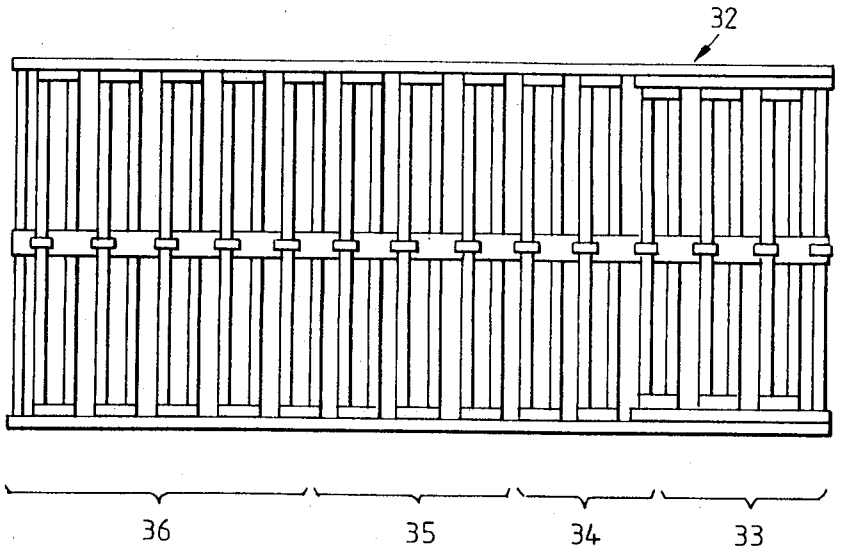
Figure 9:
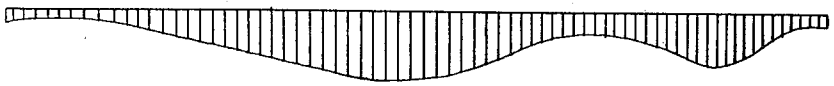

A preferred embodiment of the invention and the use thereof will now be described in detail with reference to the accompanying drawings, in which:

FIG. 1 is a longitudinal section through an upper and a lower spring-slat and the mounting supports, FIG. 2 is an exploded perspective view of a mounting support for four spring-slats with an upper and a lower spring-slat, FIG. 3 is a front elevation of a mounting support for four spring-slats, FIG. 4 is a top plan view of the mounting support, FIG. 5 is a cross-section taken on the line V—V of FIG. 6, FIG. 6 is a rear elevation of the mounting support, FIG. 7 is a perspective view of a detail broken away from the middle portion of the upper spring-slats, showing the central strap, FIG. 8 is a top plan view of the spring-slat arrangement used in a bedstead, and FIG. 9 is a diagram of the forces acting upon the spring-slats.

As shown in FIG. 1, the spring-slat arrangement for a bedstead comprises two mounting supports 3 and 4 for the resilient slats, insertable in longitudinal beams 1 and 2 of the bedstead, as well as two upper spring-slats 5 and 6 serving as a support for a mattress and two lower spring-slats 7 and 8 which prevent unlimited sagging of upper spring-slats 5 and 6. Mounting supports 3 and 4 each comprise a retaining plate 9 and 10 insertable in beams 1 and 2 and a tiltable holding part 11 and 12, movable vertically up and down, for the spring-slats. Retaining plates 9 and 10 are respectively inserted in recesses 15 and 16 of longitudinal beams 1 and 2 by means of extension pieces 13 and 14. Upper spring-slats 5 and 6 are elastically connected to one another by means of a central strap 17.

As may be seen from FIG. 1, upper spring-slats 5, 6 are convexly curved upward toward the mattress. Lower spring-slats 7 and 8 are of an undulating shape, with the peak of one undulation situated beneath the middle of the upper spring-slat.

FIG. 2 shows the spring-slat arrangement in an exploded perspective view. Retaining plate 9 includes a plug 18 on which holding part 11 fits. Disposed in a holder 19 below plug 18 is an elastic bearing pad 20 which makes possible a resilient vertical deflection of holding part 11. Part 11 comprises four receptacles 21–24 in which the two upper spring-slats 5 and 6 for supporting the mattress and the two lower undulating spring-slats 7 and 8 for limiting the deflection are held.

The two upper spring-slats 5 and 6 have a broadened cross-section in the middle and are exceptionally yielding and resilient in construction. The arrangement of spring-slats situated one above the other makes possible a progressive spring action. When a person first lies down on the mattress, a soft springing takes place; after a certain deflection of the upper spring-slat, amounting to some 2–6 cm., the lower, undulating spring-slat is also loaded, and thus sagging of the mattress in the region of heavier parts of the body can be avoided. The bed can be divided into various zones of loading, with lower slats being provided or not, according to the degree of loading. Furthermore, it would also be possible to dispose only one upper and one lower spring-slat in a mounting support 3. The spring-slats are preferably reinforced top and bottom with glass fibers.

Between the upper (5, 6) and lower (7, 8) spring-slats, one or more foamed spacers of differing hardness and/or thickness may be disposed in order to vary the springiness of the upper spring-slat within the first flexure zone.

FIG. 3 shows a holding part 11 for two upper and two lower spring-slats in elevation, viewed from the slat side. The elongated vertical opening 25 in the middle section 26 of part 11 is intended to be fitted over plug 18 in retaining plate 9. Holding part 11, together with the spring-slats, can carry out both a tilting movement and a springy, up-and-down vertical movement.

Within receptacles 21–24 are reinforcing struts 27 and longitudinal ribs 28 for better gripping of the spring-slats.

FIG. 4 shows in top plan view holding part 11 with upper spring-slats 5 and 6 and lower spring-slats 7 and 8 inserted therein.

FIG. 5 is a section taken on the line V—V of FIG. 6, which shows holding part 11 from the side opposite the slats, i.e., viewed from the longitudinal beam of the bedstead. Middle section 26 includes reinforcing ribs 29 connected to receptacles 21–24.

FIG. 7 depicts the middle region of upper spring-slats 5 and 6 with central strap 17 running along the longitudinal axis of the bed. Strap 17 consists of two single elastic straps 30 and 31 interwoven, the wider strap 30 having punched-out apertures through which the narrower strap 31 is laced. As compared with prior art central straps, strap 17 has the advantage that there are no locations where excessively great stretching of the elastic material takes place, in which connection ozone cracks can be avoided when natural rubber is used. For example, prior art central straps comprise two single straps disposed side by side and wound through the slats oppositely, which, besides the drawback mentioned above, yield a poorer guidance of the spring-slats. In the bends described by single straps 30 and 31, only flat angles occur, making possible a greater motional play of the spring-slats in strap 17. By means of the central strap, the movements of the spring-slats are synchronized with each other. The central strap likewise aids in returning the spring-slats to the center position after the load has subsided. The central strap further makes co-loading of adjacent spring-slats possible.

FIG. 8 shows a bedstead 32 with the spring-slats illustrated in the preceding drawing figures and described above. Bedstead 32 is divided into four zones of differing firmness. In the diagram of FIG. 9, the forces acting vertically upon the spring-slats along the longitudinal axis of the body are represented. For the region where the head lies, zone 33 of medium firmness has been selected, for the shoulder region a softer zone 34, for the torso a hard zone 35, and for the leg region another medium-firm zone 36, as shown in the diagram of FIG. 9.

In the bedstead embodiment illustrated in FIG. 8, mounting supports for two adjacent spring-slats have been provided throughout. In the hard zone 35, lower spring-slats are provided as well. In this region, which takes the main weight of the body, sagging of the mattress is to be avoided despite optimum spring action. In zone 34, the mattress support, i.e., the spring-slats, should adapt itself to the salient shoulder portion; therefore, soft upper spring-slats are utilized in this zone. In zones 33, 35, and 36, harder upper spring-slats are provided. Through the selection of differing degrees of hardness of the upper spring-slats and the additional provision of lower spring-slats, the bed automatically adjusts to any body form and any body weight whatsoever.

What is claimed is:

1. A bed comprising a bedstead having two lateral, longitudinal beams, a mattress, and a plurality of upper and lower spring-slat arrangements each including two spring-slat mounting supports insertable in said bedstead beams for vertical deflection and tilting of said spring-slats, said upper spring-slats serving as a support for said mattress, said lower spring-slats preventing said mattress from sagging, said upper spring-slats deflecting alone in a first flexure zone, and said upper spring-slats deflecting together with said lower spring-slats in a second flexure zone said upper and lower spring-slats being unconnected to each other between said mounting supports.

2. The bed of claim 1, wherein said bedstead is divided into zones of differing degrees of firmness.

3. The bed of claim 2, wherein said spring-slat arrangements of at least one of said zones comprise upper and lower said spring-slats, at least a further one of said zones having only spring-slat arrangements with upper said spring-slats.

4. The bed of claim 2, comprising upper said spring-slats having at least two different degrees of hardness according to the one of said zones in which said upper spring-slats are situated.

5. The bed of claim 1, further comprising two interwoven elastic straps connecting said upper spring-slats in the mid-regions thereof.

6. A spring-slat arrangement for use in a bed of the type having parallel, longitudinal beams, the spring-slat arrangement comprising a plurality of sets of spring-slats parallel to one another and to a transverse direction of said bed, wherein each set comprises at least one pair of spring-slats comprising an upper slat and a lower slat, means for holding said upper slat above said lower slat in a spaced apart relationship therewith, said lower slat having an undulation peak situated below a mid-region of said upper slat, said arrangement further comprising support means situated on the parallel longitudinal beams of said bed, for separately receiving the ends of said spring-slats, said arrangement being such that upon application of a load onto said upper spring slats the latter undergo a first deflection until their mid-regions contact the said undulation peak of the corresponding lower spring-slats, and thereafter a second deflection together with said lower spring-slats while remaining in contact therewith.

7. A spring-slat arrangement as claimed in claim 6, wherein said upper spring-slats are convexly bent upward, and comprise an upper mid-region.

8. A spring-slat arrangement as claimed in claim 6, wherein said lower spring-slats comprise an undulating shape with at least two lower portions, with one located on each side of said undulation peak.

9. The spring-slat arrangement of claim 6, wherein each of said upper spring-slats has a broadened cross-section in the mid-region thereof.

10. A spring-slat arrangement for use in a bed of the type having parallel longitudinal beams, the arrangement comprising a plurality of sets of spring-slats composed of at least an upper and a lower slat parallel to one-another and to a transverse direction of said bed, wherein each said set comprises at least one pair of support means situated on the parallel longitudinal beams of said bed, for holding both ends of said slats, each said support means comprising a solid holding part having at least one pair of recesses located in superposed relationship, and adapted for receiving one of the ends of each one of said slats of said pair and a retaining member able to be secured to one of said beams, said retaining members being arranged for resiliently supporting said holding part while permitting it to effect a tilting movement upon a deformation imparted to said lower and/or said upper slat.

11. A spring-slat arrangement as claimed in claim 10, wherein each of said holding parts comprises two pairs of recesses, each having an upper and lower recess, both said upper and lower recesses being situated at the same height respectively, and each of said sets of spring-slats comprising two pairs of slats in superposed relationship.

12. A spring-slat arrangement as claimed in claim 10, wherein each said retaining members comprise a plate, means for securing said plate in a vertical position to a said beam, a holder projecting at the lower end of said plate, an elastic bearing pad supported by said holder and adapted for receiving one of said holding parts, said holder being arranged for permitting a tilting movement of a holding part placed on said pad, while said elastic bearing pad permits a resilient vertical deflection thereof.

* * * * *